US011649693B2

(12) United States Patent
Almajid et al.

(10) Patent No.: US 11,649,693 B2
(45) Date of Patent: May 16, 2023

(54) HANDLING PRODUCED WATER IN A WELLBORE

(71) Applicant: Saudi Arabian Oil Company, Dhahran (SA)

(72) Inventors: Muhammad Majid Almajid, Qatif (SA); Ahmed J. Alzayer, Sihat (SA); Ahmed M. Alghuryafi, Udhailiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 18 days.

(21) Appl. No.: 17/173,554

(22) Filed: Feb. 11, 2021

(65) Prior Publication Data

US 2022/0251926 A1 Aug. 11, 2022

(51) Int. Cl.

| | |
|---|---|
| ***E21B 34/06*** | (2006.01) |
| ***E21B 43/12*** | (2006.01) |
| ***E21B 43/25*** | (2006.01) |

(52) U.S. Cl.

CPC ..... *E21B 34/066* (2013.01); *E21B 43/12* (2013.01); *E21B 43/25* (2013.01)

(58) Field of Classification Search

CPC ..... E21B 34/066; E21B 43/12; E21B 43/20; E21B 43/25; E21B 43/40

See application file for complete search history.

(56) References Cited

U.S. PATENT DOCUMENTS 3,354,952 A * 11/1967 Engle ..... E21B 43/20 166/266
3,469,630 A 9/1969 Hurd et al.
4,313,500 A 2/1982 Johnson, Jr. et al.
(Continued)

FOREIGN PATENT DOCUMENTS

RU 2215129 C1 10/2003

OTHER PUBLICATIONS

Alghamdi et al., "SmartWater Synergy with Surfactant Chemicals: An Electro-Kinetic Study," SPE-197239-MS, Society of Petroleum Engineers (SPE), presented at the Abu Dhabi International Petroleum Exhibition and Conference, Nov. 11-14, 2019, 12 pages.
(Continued)

*Primary Examiner* — Matthew R Buck
(74) *Attorney, Agent, or Firm* — Fish & Richardson P.C.

(57) ABSTRACT

A method includes receiving, by a processing device and from one or more sensors coupled to a water reservoir storing water received from a separator, fluid information. The fluid information includes a water level of the water reservoir. The separator is fluidically coupled to a wellbore string disposed within a wellbore. The method also includes determining, based on the fluid information, operation mode instructions. The method also includes transmitting, to a controller communicatively coupled to at least one flow regulation device fluidically coupled to the wellbore string, the operation mode instructions. The controller controls, based on the instructions, the at least one flow regulation device to regulate, during a production mode of the wellbore string, a flow of production fluid from the wellbore string to the separator or regulating, during a water injection mode of the wellbore string, a flow of water from the water reservoir into the wellbore string.

20 Claims, 8 Drawing Sheets

(56) References Cited

U.S. PATENT DOCUMENTS

| | | | | |
|---|---|---|---|---|
| 4,319,635 | A * | 3/1982 | Jones | E21B 43/40 166/227 |
| 4,643,256 | A | 2/1987 | Dilgren et al. | |
| 4,982,789 | A | 1/1991 | Prukop | |
| 6,691,781 | B2 | 2/2004 | Grant et al. | |
| 7,152,682 | B2 | 12/2006 | Hopper | |
| 7,686,086 | B2 * | 3/2010 | Brammer | E21B 43/40 166/267 |
| 8,327,941 | B2 | 12/2012 | Hackworth et al. | |
| 8,985,206 | B2 | 3/2015 | Morvan et al. | |
| 9,284,480 | B2 | 3/2016 | Han et al. | |
| 9,969,928 | B2 | 5/2018 | He et al. | |
| 2008/0017594 | A1 * | 1/2008 | Sarshar | E21B 43/34 210/512.1 |
| 2016/0009981 | A1 | 1/2016 | Teklu et al. | |
| 2016/0356143 | A1 * | 12/2016 | Eie | C02F 1/00 |
| 2019/0194524 | A1 | 6/2019 | Ayirala et al. | |

OTHER PUBLICATIONS

Alghazal et al., "Integrated Water Management and Surveillance Strategies in a Giant Carbonate Field from Saudi Arabia," SPE 164421, Society of Petroleum Engineers (SPE), presented at the SPE Middle East Oil and Gas Show and Conference, Manama, Bahrain, Mar. 2013, 8 pages.

Liu et al., "Favorable Attributes of Alkaline-Surfactant-Polymer Flooding," SPE 99744, Society of Petroleum Engineers (SPE), presented at the 2006 SPE/DOE Symposium on Improved Oil Recovery, Apr. 22-26, 2006, SPE Journal, Mar. 2008, 12 pages.

Ma et al., "Adsorption of Cationic and Anionic Surfactants on natural and Synthetic Carbonate Materials," Journal of Colloid and Interface Science, 408:164-172, 2013, 9 pages.

Tagavifar et al., "Effect of pH on Absorption of Anionic Surfactants on Limestone: Experimental Study and Surface Complexation Modeling," Colloids and Surfaces A: Physicochemical and Engineering Aspect 538:549-558, Feb. 5, 2018, 10 pages.

Zhang et al., "Favorable Attributes of Alkali-Surfactant-Polymer Flooding," SPE 99744, Society of Petroleum Engineers (SPE), presented at the 2006 SPE/DOE Symposium on Improved Oil Recovery, Apr. 22-26, 2006, 13 pages.

PCT International Search Report and Written Opinion in International Appln. No. PCT/US2022/016132, dated May 11, 2022, 21 pages.

* cited by examiner

HANDLING PRODUCED WATER IN A WELLBORE

FIELD OF THE DISCLOSURE

This disclosure relates to wellbores, in particular, to production wellbores.

BACKGROUND OF THE DISCLOSURE

Production wellbores are used for hydrocarbon production. Some production wellbores are placed in formations that have unwanted fluids such as water or gas. For example, production wellbores can be bounded by or in fluid communication with downhole water reservoirs or aquifers. Pressure changes in the formation can cause the unwanted fluids to mix with the hydrocarbons. During production operations, such unwanted fluids can be produced and brought to the surface of the wellbore. Managing these unwanted fluids can be costly and time-consuming. Methods and equipment for managing unwanted fluids are sought.

SUMMARY

Implementations of the present disclosure include a method that includes receiving, by a processing device and from one or more sensors coupled to a water reservoir storing water received from a separator, fluid information. The fluid information includes a water level of the water reservoir. The separator is fluidically coupled to a wellbore string disposed within a wellbore. The method also includes determining, based on the fluid information, operation mode instructions. The method also includes transmitting, to a controller communicatively coupled to at least one flow regulation device fluidically coupled to the wellbore string, the operation mode instructions. The controller controls, based on the instructions, the at least one flow regulation device to regulate, during a production mode of the wellbore string, a flow of production fluid from the wellbore string to the separator or regulating, during a water injection mode of the wellbore string, a flow of water from the water reservoir into the wellbore string.

In some implementations, the method also includes, before determining the operation mode instructions, comparing, by the processing device, the fluid information to a water level threshold. Determining the operation mode instructions includes determining, based on a result of the comparison, one of 1) instructions to initiate a production mode of the wellbore string, or 2) instructions to initiate a water injection mode of the wellbore string.

In some implementations, the one or more sensors include a first sensor and a second sensor, the fluid information including at least one of a high water level detected by the first sensor or a low water level detected by the second sensor, wherein determining the operation mode instructions includes determining one of 1) instructions to initiate the water injection mode based on the fluid information including a high water level, or 2) instructions to initiate the production mode based on the fluid information including a low water level.

In some implementations, at least one flow regulation device includes a first valve and a second valve. The first valve is attached to the wellbore string. The first valve resides at a production zone. The second valve is attached to the wellbore string and resides at a water injection zone. The controller is coupled to the first valve and the second valve. The controller is configured to 1) upon receiving instructions to initiate the water injection mode, close the first valve and open the second valve, allowing the water to be injected into the water injection zone through the wellbore string, and configured to 2) upon receiving instructions to initiate the water production mode, close the second valve and open the first valve, allowing the production fluid to flow through the wellbore string to the separator.

In some implementations, the controller is operationally coupled to a fluid pump fluidically coupled to the water reservoir and disposed upstream of the wellbore string. The controller activates, during the water injection mode, the fluid pump, flowing the water from the water reservoir to the wellbore string, and into the water injection zone.

Implementations of the present disclosure also include a wellbore assembly that includes a wellbore string disposed within a wellbore. The wellbore string extends from a surface of the wellbore to a downhole location of the wellbore. The wellbore includes a production zone and a water injection zone. The wellbore assembly also includes a separator disposed at the surface of the wellbore. The separator is fluidically coupled to the wellbore string and configured to receive, during a production mode of the wellbore assembly, production fluid from the wellbore string flown from the production zone. The separator separates water from the production fluid. The wellbore assembly also includes a water reservoir disposed at the surface of the wellbore and fluidically coupled to the separator and to the wellbore string. The water reservoir receives and stores, from the separator, the water separated from the production fluid. The water reservoir flows, to the wellbore string during an injection mode of the wellbore assembly, the water, allowing the wellbore string to flow the water to the water injection zone.

In some implementations, the water reservoir flows water to the wellbore string upon reaching a predetermined water level. In some implementations, the wellbore assembly also includes one or more sensors attached to the water reservoir, a controller, and a processing device disposed at or near the surface of the wellbore. The processing device is communicatively coupled to the controller and to the one or more sensors. The processing device receives, from the one or more sensors, fluid information including a water level in the reservoir. The processing device determines, based on the fluid information, a command to initiate the production mode or the water injection mode. The processing device transmits, to the controller, the command. The controller is coupled to at least one flow regulation device fluidically coupled to the wellbore string and configured to control, based on the command, the flow regulation device, regulating a flow of fluid from the wellbore string or into the wellbore string. In some implementations, the one or more sensors include a first sensor that detects a high water level in the reservoir and a second sensor that detects a low water level in the reservoir. The processing device determines, based on the fluid information including a high water level, a first command to initiate the water injection mode. The processing device determines, based on the fluid information including a low water level, a second command to initiate the production mode.

In some implementations, the wellbore assembly also includes a first valve and a second valve. The first valve is attached to the wellbore string and resides at the production zone. The second valve is attached to the wellbore string and resides at the water injection zone. The controller is coupled to the first valve and the second valve. The controller is configured to 1) upon receiving the first command to initiate the water injection mode, close the first valve and open the second valve, allowing the water to be injected into the water injection zone through the wellbore string, and configured to 2) upon receiving the second command to initiate the water production zone, close the second valve and open the first valve, allowing the production fluid to flow up the wellbore string to the separator.

In some implementations, the wellbore assembly also includes a pump fluidically coupled to the water reservoir and disposed upstream of the wellbore string. The pump flows the water from the water reservoir to the wellbore string and into the water injection zone.

In some implementations, the separator includes a portable separator and the water reservoir includes a portable water tank.

In some implementations, the wellbore includes a vertical portion and a non-vertical portion. The non-vertical portion extends from the vertical portion into the production zone, and the production zone is isolated from the water injection zone.

In some implementations, the wellbore includes a multilateral wellbore including a vertical wellbore, a first non-vertical wellbore extending from a first section of the vertical wellbore, and a second non-vertical wellbore extending from a second section of the vertical wellbore. The wellbore string includes a main wellbore string extending from the surface of the wellbore to a downhole location of the wellbore. The wellbore string also includes a production string fluidically coupled to and extending from the main wellbore string into the first non-vertical wellbore. The production string flows production fluid from the first non-vertical wellbore to the wellbore string. The water injection string is fluidically coupled to and extends from the wellbore string into the second non-vertical wellbore. The water injection string receives and flows water from the wellbore string to the second non-vertical wellbore.

In some implementations, the separator is fluidically coupled to the main wellbore string and receives, during the production mode and from the main wellbore string, the production fluid flown from the production string to the main wellbore string. The water reservoir is fluidically coupled to and is configured to flow, during the water injection mode, water to the main wellbore string, allowing the wellbore string to flow the water to the water injection string.

Implementations of the present disclosure also include a system that includes at least one processing device and a memory communicatively coupled to the at least one processing device. The memory stores instructions which, when executed, cause the at least one processing device to perform operations that include receiving, by a processing device and from one or more sensors coupled to a water reservoir storing water received from a separator, fluid information. The fluid information includes a water level of the water reservoir. The separator is fluidically coupled to a wellbore string disposed within a wellbore. The operations also include, based on the fluid information, determine operation mode instructions. The operations also include transmitting, to a controller communicatively coupled to at least one flow regulation device fluidically coupled to the wellbore string, the operation mode instructions. The controller controls, based on the instructions, at least one flow regulation device thereby regulating, during a production mode, a flow of production fluid from the wellbore string to the separator or regulating, during a water injection mode, a flow of water from the water reservoir into the wellbore string.

In some implementations, the operations further include, before determining the operation mode instructions: comparing, by the processing device, the fluid information to a water level threshold. Determining the operation mode instructions includes determining, based on a result of the comparison, one of 1) instructions to initiate a production mode of the wellbore string, or 2) instructions to initiate a water injection mode of the wellbore string.

In some implementations, the one or more sensors include a first sensor and a second sensor. The fluid information includes at least one of a high water level detected by the first sensor or a low water level detected by the second sensor. Determining the operation mode instructions includes determining one of 1) instructions to initiate the water injection mode based on the fluid information including a high water level, or 2) instructions to initiate the production mode based on the fluid information including a low water level.

In some implementations, the at least one flow regulation device includes a first valve attached to the wellbore string and residing at the production zone, and a second valve attached to the wellbore string and residing at the water injection zone. The controller is coupled to the first valve and the second valve. The controller is configured to 1) upon receiving instructions to initiate the water injection mode, close the first valve and open the second valve, allowing the water to be injected into the water injection zone through the wellbore string, and configured to 2) upon receiving instructions to initiate the water production zone, close the second valve and open the first valve, allowing the production fluid to flow through the wellbore string to the separator.

In some implementations, the controller is operationally coupled to a fluid pump fluidically coupled to the water reservoir and disposed upstream of the wellbore string. The controller is configured to activate, during the water injection mode, the fluid pump, flowing the water from the water reservoir to the wellbore string, and into the water injection zone.

DETAILED DESCRIPTION OF THE DISCLOSURE

The present disclosure describes a wellbore assembly or system for managing unwanted production fluids of a production wellbore. The wellbore assembly includes a separator, a water reservoir (e.g., a water tank), downhole valves, and a controller. The separator is connected to and receives production fluid from the wellbore string. The separator separates the produced water from the hydrocarbons near the wellhead and the water tank is used to temporarily store and reinject the water back into the water-bearing zone using the same production string. The controller controls the downhole valves to change the wellbore string between production and injection modes. The re-injected water can be disposed at a downhole downhole water reservoir or it can be injected near the hydrocarbon reservoir to rejuvenate the hydrocarbon reservoir.

Particular implementations of the subject matter described in this specification can be implemented so as to realize one or more of the following advantages. Recycling or re-injecting the water at the wellbore location can benefit the environment by eliminating the need of discharging the water to a nearby surface water body, or by eliminating the need of treating the water at a treatment facility. Increased field water production often requires a facility upgrade. The wellbore assembly of the present disclosure can help delay or eliminate the need to upgrade the field facilities and provide a cost-effective way of handling the excess water. Additionally, the wellbore assembly of the present disclosure can be installed in remote or hard-to-access wellbores in which installing a standalone water processing facility is no possible or is impractical. Re-injecting the water into the same wellbore can help revitalize the production of mature fields. The equipment used to re-inject the produced water can be portable, allowing the equipment to be quickly installed in newly drilled wells as well as old wells, such as wells that are candidates for sidetracking. Additionally, the wellbore assembly of the present disclosure can save time and resources by eliminating the need of drilling a separate disposal wellbore.

Figure 1:
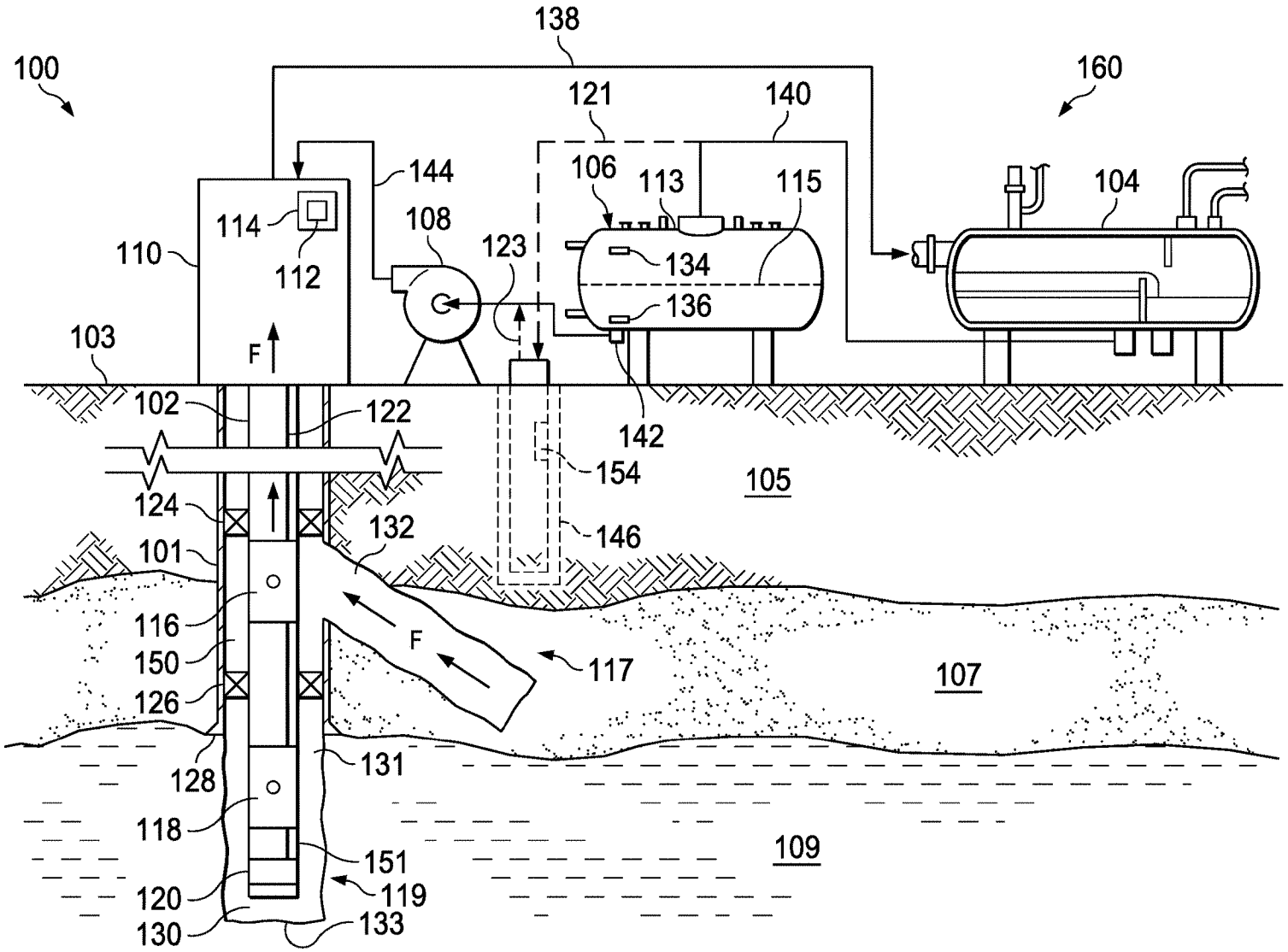
FIG. 1 is a front schematic view of a wellbore assembly according to a first implementation of the present disclosure, the wellbore assembly in production mode.

FIG. 1 shows a wellbore assembly 100 that includes a wellbore string 102 disposed within a wellbore 101 formed in a geologic formation 105. The geologic formation 105 includes a hydrocarbon reservoir 107 from which hydrocarbons can be extracted, and a downhole water reservoir 109 (e.g., a water formation) into which water or other unwanted fluids can be injected. The hydrocarbon reservoir 107 and the water reservoir 109 can reside in a common formation later, they can reside next to each other, or they can be separated by one or more layers or reservoirs of the formation 105.

The wellbore 101 extends from a surface 103 (e.g., a ground surface) of the wellbore 101 to a downhole end 133 of the wellbore 101. The wellbore includes a production zone 117 and a water injection zone 119. For example, the production zone 117 can be a zone or region at the wellbore 101 where hydrocarbons flow into the drill string 102, and the water injection zone 119 can be a zone or region at the wellbore into which water can be injected from the wellbore string 102. The wellbore 101 can include a vertical portion 131 that includes the water injection zone 119 and a non-vertical portion 132 that includes the production zone 117. The production zone 117 of the wellbore 101 penetrates the hydrocarbon reservoir 107 and the water injection zone 119 penetrates the downhole water reservoir 109. In some implementations, the water injection zone 117 and the production zone 117 can be in the same reservoir such as in the hydrocarbon reservoir 107.

The wellbore 101 can include cased portions and open hole sections. For example, the vertical portion 131 of the wellbore 101 can be cased down to a casing shoe 128. The rest of the vertical wellbore 131 can be an open hole section where water can penetrate or enter the water reservoir 109. Similarly, the non-vertical portion 132 can include an open hole section where hydrocarbons can flow from the reservoir 107.

The wellbore string 102 is used for both hydrocarbon production and water injection. The wellbore string 102 extends from the surface 103 of the wellbore to a downhole location of the wellbore at or near the downhole end 133 of the wellbore 101. The wellbore string 102 can be a vertical string or, as shown and further described in detail below with respect to FIGS. 3-6, can include a vertical portion and a non-vertical portion.

The wellbore assembly 100 also includes packers 124 and 126 (e.g., an isolation packer that includes anchors and rubber elements) to isolate portions of the wellbore. For example, a first packer 124 forms, with a second packer 126, an isolated region 150 or annulus where production fluid 'F' flows and can enter the wellbore string 102. The production zone is part of the isolated region 150. The second packer 126 separates the isolated region 150 from a second isolated region 151 where water can flow and enter the water injection zone 109. The water injection zone 119 is part of the second isolated region 151.

The wellbore assembly 100 also includes a piping system 160 (e.g., a portable or temporary piping system) that includes a separator 104 (e.g. a three-phase separator) and a water reservoir 106 (e.g., a water tank 113 disposed at the surface 103 of the wellbore 101, a pond, a cistern, or a cased wellbore 146). The wellbore assembly 100 also includes a processing device 112, a controller 114, a first downhole valve 116 (e.g., an inflow control valve), and a second downhole valve 118 (e.g., an inflow control valve). Each of the first and second downhole valves 116 and 118 are communicatively coupled to the controller 112. The wellbore assembly 100 can also include a first sensor 134 and a second sensor 136 attached to the water tank 113, and a pump 108 fluidically coupled to and configured to flow water from the tank to the wellbore string 102.

The processing device 112 can be a computer processor or other type of processing device. The processing device 112 is disposed at or near the surface 103 of the wellbore 101. The processing device 112 is communicatively coupled to the controller 114 and to the sensors 134 and 136. The processing device 112 and the controller 114 can be part of a common panel at the surface of the wellbore. Additionally, the controller 114 and the processing device 112 can be part of a common device or they can reside at separate locations. The processing device 112 receives, from the sensors 134 and 136, fluid information that includes a water level in the tank 113. The processing device 112 has logic or instructions to process the sensor information. The processing device 114 determines, based on the fluid information, a command or operation mode instructions to initiate a production mode or the water injection mode of the wellbore assembly 101.

Figure 2:
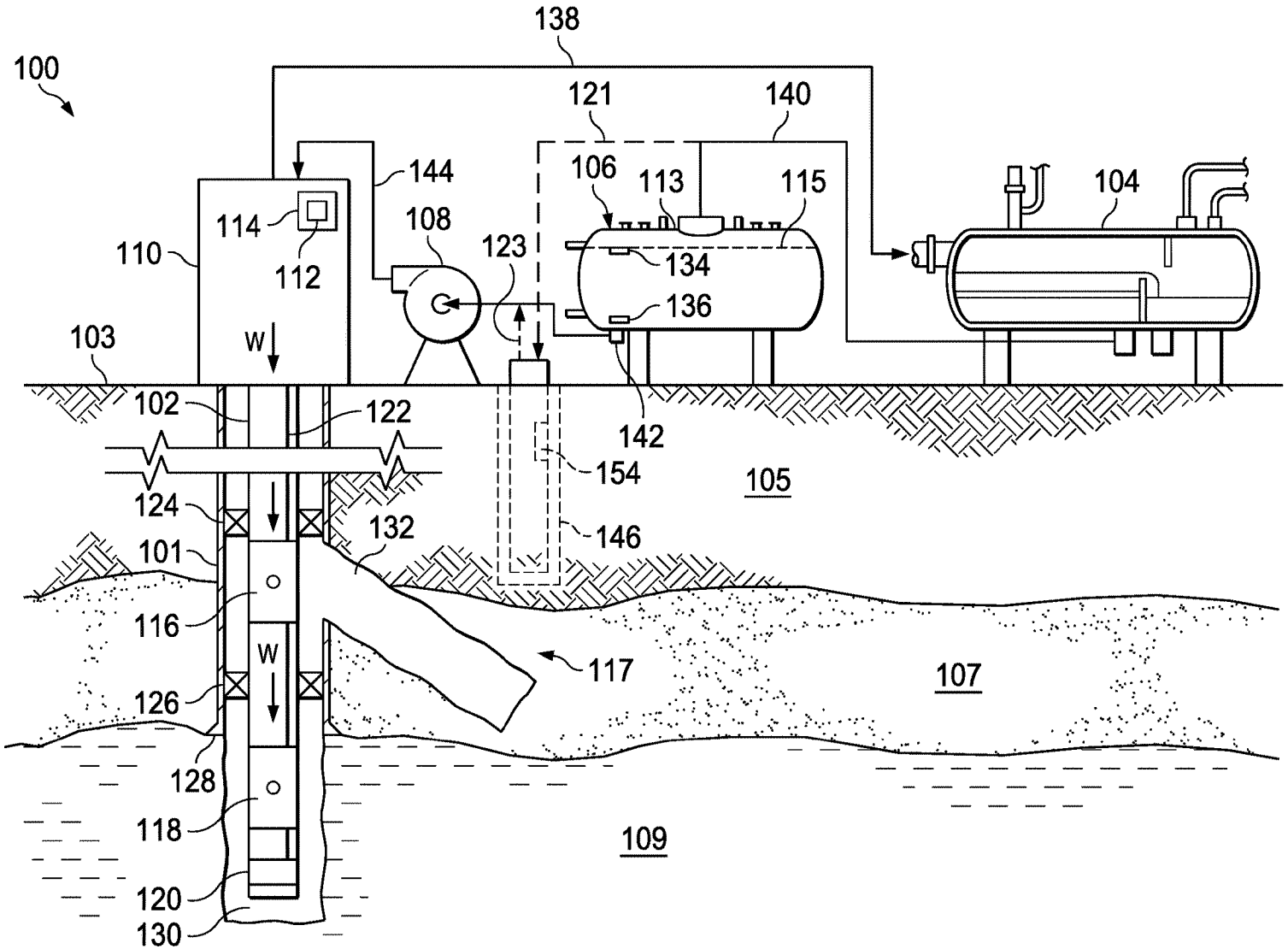
FIG. 2 is a front schematic view of the wellbore assembly of FIG. 1, in water injection mode.

During the production mode, production fluid 'F' flows from the hydrocarbon reservoir 107 to the wellbore string 102 (e.g., through the inflow control valve 116), and from the wellbore string 101 to the separator 104. Referring briefly to FIG. 2, during the water injection mode, water 'W' flows from the water reservoir 106 to the wellbore string 102, and from the wellbore string 102 to the downhole water reservoir 109 (e.g., through the inflow control valve 118).

Still referring to FIG. 1, the processing device 112 transmits, to the controller 114, the operation mode instructions. The controller 114 is communicatively coupled to the first downhole inflow control valve (ICV) 116 and the second downhole inflow control valve (ICV) 118. During production mode, the controller 114 actuates or controls, based on the operation mode instructions, the valves 116 and 118 to regulating a flow of production fluid 'F' from the wellbore string 102 into the separator 104. During water injection mode, the controller 114 actuates or controls, based on the operation mode instructions, the valves 116 and 118 regulating a flow of water 'W' from the water tank 113 into the wellbore string 102. The controller 114 can also actuate the pump 108 and any other valves of the piping system 160 at the surface of the wellbore.

At the surface 103, the piping system 160 resides near a wellhead 110 of the wellbore 101. The wellbore string 102 extends downhole from the wellhead 110. The wellhead 110 is fluidically coupled to the separator 104 through a fluid line 138. The separator 104 is fluidically coupled to the water tank 113 through a water line 140. The water tank 113 is fluidically coupled to the pump 108 through a water line 142. The pump 108 is fluidically coupled to the wellhead 110 through a water line 144.

As shown in dashed lines, in some implementations, instead or in addition to the water tank 113, the water can be stored in a cased wellbore 146 (e.g., a water storage wellbore). The cased wellbore can have one or more sensors 154 that detect the water level inside the water wellbore 146. The separator 104 can be fluidically coupled to the water storage wellbore 146 through a water line 121 and the water storage wellbore 146 can be fluidically coupled to the pump 108 through a water line 123.

The downhole valves 116 and 118 can include inflow control valves or any type of flow regulation device, such as shifting sleeves. For example, valve 116 can be an inflow valve that received production fluid 'F' from the hydrocarbon reservoir 107, and valve 118 can be an outflow valve that flows water 'W' to the downhole water reservoir 109. During production, the inflow valve 116 can receive fluid from the hydrocarbon reservoir 107 and the outflow valve 118 can remain closed to prevent water from flowing up the wellbore string 102. During water injection, the inflow valve 116 remains closed to prevent hydrocarbons from entering the wellbore string 102 and the outflow valve 118 remains open to flow water into the downhole water reservoir 109. The downhole valves 116 and 118 are communicatively coupled to the controller 114 through a cable 122 or wirelessly.

As shown in FIGS. 1 and 2, the water reservoir 106 can be a water tank 113 (e.g., a portable water tank) or another type of water container. The water tank 113 can have a capacity that is at least four times the tubing capacity. The capacity of the tank 113 is large enough to allow the wellbore 101 to produce hydrocarbons for an extended period of time before having to switch to the water injection mode. The water tank 113 is used to store water until the water inside the tank reaches a certain level. Upon reaching such level, the water tank 113 flows the water to the wellbore string 102 during the water injection mode. When the wellbore assembly 102 switches to water injection mode, some water may be left in the wellbore string 102 and in the water lines 144 and 142 at the surface 103. The size of the tank 113 is large enough to take the water left in these pipes and string 102, while leaving enough room for more water received from the separator 104 during the production mode. The water tank 113 can be a portable tank that is quickly movable from one wellbore to another. The water tank 113 is fluidically coupled to the separator 104 and to the wellbore string 102. The water tank 113 receives water from the separator 104 and stores the water temporarily. The water tank 113 flows, to the wellbore string 102, the water, allowing the wellbore string 102 to flow the water to the water injection zone. Additionally, the separated water can be cleaned of emulsions/precipitates before reaching the water tank 113.

The fluid pump 108 injects water from the tank 113 to the wellbore string 102. The capacity of that pump 108 can be optimized such that the anticipated differential pressure needed for compression of the water is achieved to inject the water in the downhole water reservoir 109. In some implementations, the water tank 113 can replace the use of a separate pump 108. For example, the water tank 113 can include a hydro pneumatic tank that has an internal mechanism to move the water from the tank 113 to the downhole water reservoir 109. Because pressurizing water is quicker and less costly than pressurizing gas, pressurizing the water to be injected can be accomplished quickly without the need of specialized equipment.

The sensors 134 and 136 can reside inside the tank or outside the tank 113. The sensors 134 and 136 can include any type of sensing device that is capable of detecting the water level of the reservoir 106. For example, a suitable sensor is the Rosemount 5300 Level Transmitter sold by Emerson in St. Louis, M.O., or the Tankbolt Automatic Water Level Controller sold by Oakter in National Capital Region Uttar Pradesh, India. In some examples, the sensors 134 and 136 can include external capacitance transmitters that sense an interface between water and air.

The sensors 134 and 136 are communicatively coupled to the processing device 112 to transmit, in or near real time, the fluid information representing the water level of the tank 113. The first sensor 134 can detect a high water level in the tank 113 and the second sensor 136 can detect a low water level in the tank 113. For example, the first sensor 134 can detect a presence of water and the second sensor 136 can detect a presence of air. In some implementations, the sensors 134 and 136 can detect fluidic pressure, or the tank 113 can include a floater or other type of mechanism to measure the water level inside the tank 113. In some implementations, the second sensor 136 can reside at or near the bottom of the tank to detect when the water level is low enough to stop pumping water and initiate the production mode. In some implementations, the pump 108 can be configured to stop when the water pressure drops below a predetermined threshold.

In example implementations, "real time" means that a duration between receiving an input and processing the input to provide an output can be minimal, for example, in the order of seconds, milliseconds, microseconds, or nanoseconds, sufficiently fast to prevent the over-pressurization of the water tank 113.

The controller 114 resides at or near the surface 103 of the wellbore and can control multiple devices (e.g., valves, pumps, and sensors) of the piping system 160. In some implementations, the controller 114 can be disposed at the wellbore (e.g., near the valves 116 and 118) while still receiving the fluid information from the sensors 134 and 136. In some implementations, the controller 114 can be implemented as a distributed computer system. The distributed computer system can be disposed partly at the surface and partly within the wellbore. The computer system can include one or more processors and a computer-readable medium storing instructions executable by the one or more processors to perform the operations described here. In some implementations, the controller 114 can be implemented as processing circuitry, firmware, software, or combinations of them. The controller 114 can transmit signals to the valve 116 and to lift hydrocarbons flowed into the wellbore and can transmit signals to the valve 118 to inject water flowed from the water tank 113.

The first valve 116 is attached to the wellbore string 102 and resides at the production zone 117. The production zone is bounded by and isolated with packers 124 and 126. The non-vertical portion 132 of the wellbore 101 extends from the vertical portion 131 and is isolated from the water injection zone 119. The second valve 118 is attached to the wellbore string 102 and resides at the water injection zone 119.

The processing device changes between production mode and water injection mode based on the fluid information received from the sensors 134 and 136. For example, the processing device 112 determines, based on the fluid information that includes a high water level, a first command to initiate the water injection mode. Conversely, the processing device 112 determines, based on the fluid information that includes a low water level, a second command to initiate the production mode.

Referring to FIG. 2, the controller 114 can, upon receiving the first command to initiate the water injection mode, close the first valve 116 and open the second valve 118, allowing the water 'W' to be injected into the water injection zone 119 through the wellbore string 102. As shown in FIG. 1, the controller 114 also can, upon receiving the second command to initiate the water production zone, close the second valve 118 and open the first valve 114, allowing the production fluid 'F' to flow up the wellbore string 132 to the separator 104. If needed, the wellbore assembly 100 can also include a mechanical formation isolation valve (MFIV) 120 to isolate the last section of the openhole portion 130.

As shown in FIG. 1, during production mode, production fluid 'F' flows from the hydrocarbon reservoir 107 to the first valve 116 into the wellbore string 102, from the wellbore string to the wellhead 110, from the wellhead 110 to the separator 104, and at the separator, water is separated from the production fluid 'F'. In production mode, the water pump 108 is in standby or off, and no water is flown to the wellhead 110. In production mode, the second valve 118 is closed to prevent any water from flowing back from the downhole water reservoir 109 that may mix with the production fluid 'F'.

As shown in FIG. 2, during water injection mode, water 'W' flows from the water tank 113 to the pump 108, from the pump 108 to the wellhead 110, from the wellhead 108 to the wellbore string 102, from the wellbore string 102 to the second valve 118 (or to a downhole outlet of the string 102), and from the second valve 118 to the downhole water reservoir 109. In water injection mode, one or more valves at the surface prevent the flow of hydrocarbons from the separator 104 to the wellhead 110. In production mode, the first valve 116 is closed to prevent production fluid 'F' from flowing into the wellbore string 102 while allowing water 'W' to flow down to the downhole water reservoir 109. The water injected in the wellbore can stimulate the hydrocarbon reservoir 107.

To change between production mode and injection mode, the processing device 112 determines, based on the fluid information from the sensors, the operation mode instructions. For example, the processing device can compare the fluid information to a water level threshold, and then, based on a result of the comparison, the processing device can determine instructions to initiate a production mode of the wellbore string, or determine instructions to initiate a water injection mode of the wellbore string.

Figure 3:
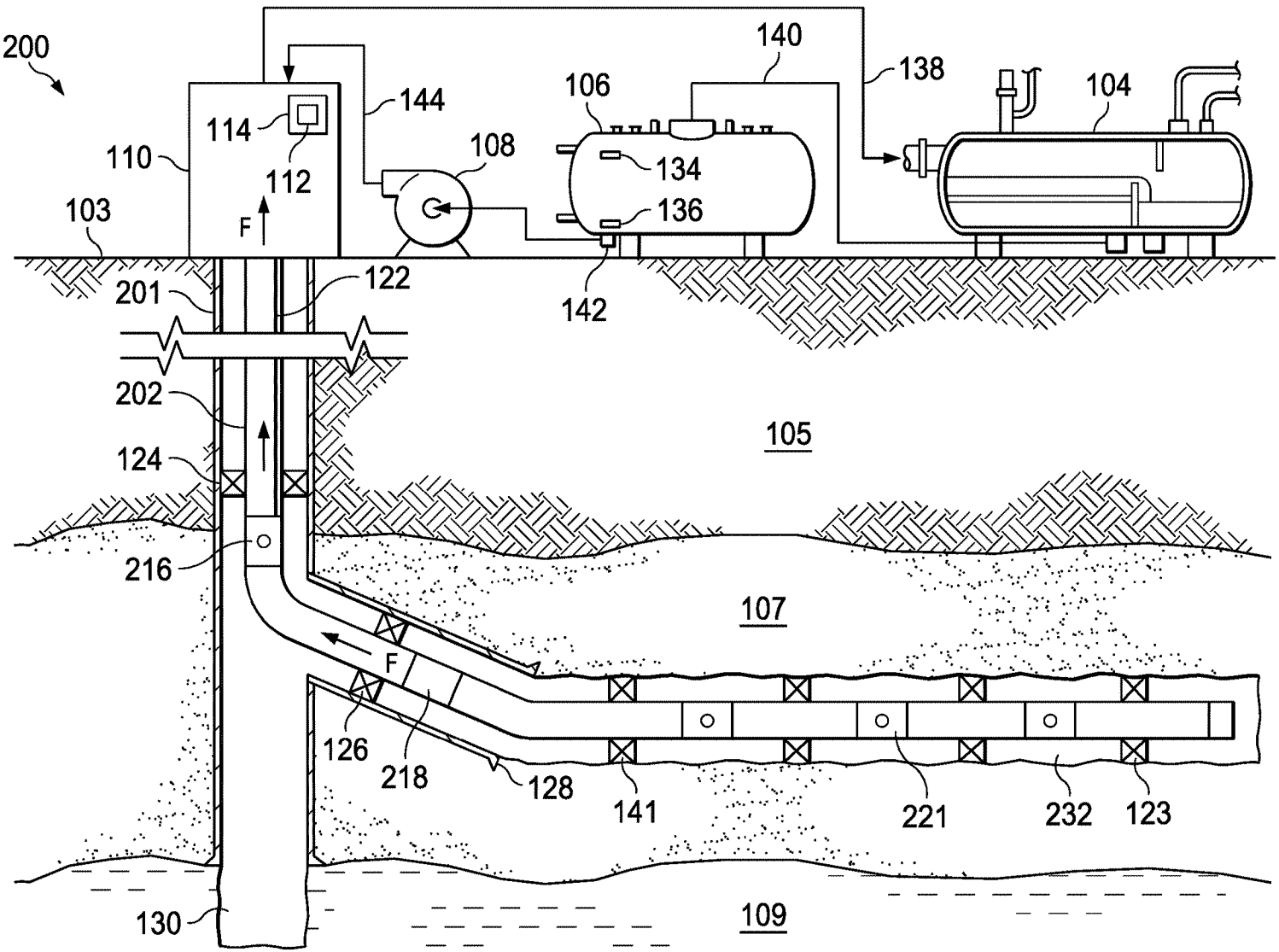
FIG. 3 is a front schematic view of a wellbore assembly according to a second implementation of the present disclosure, the wellbore assembly in production mode.
Figure 4:
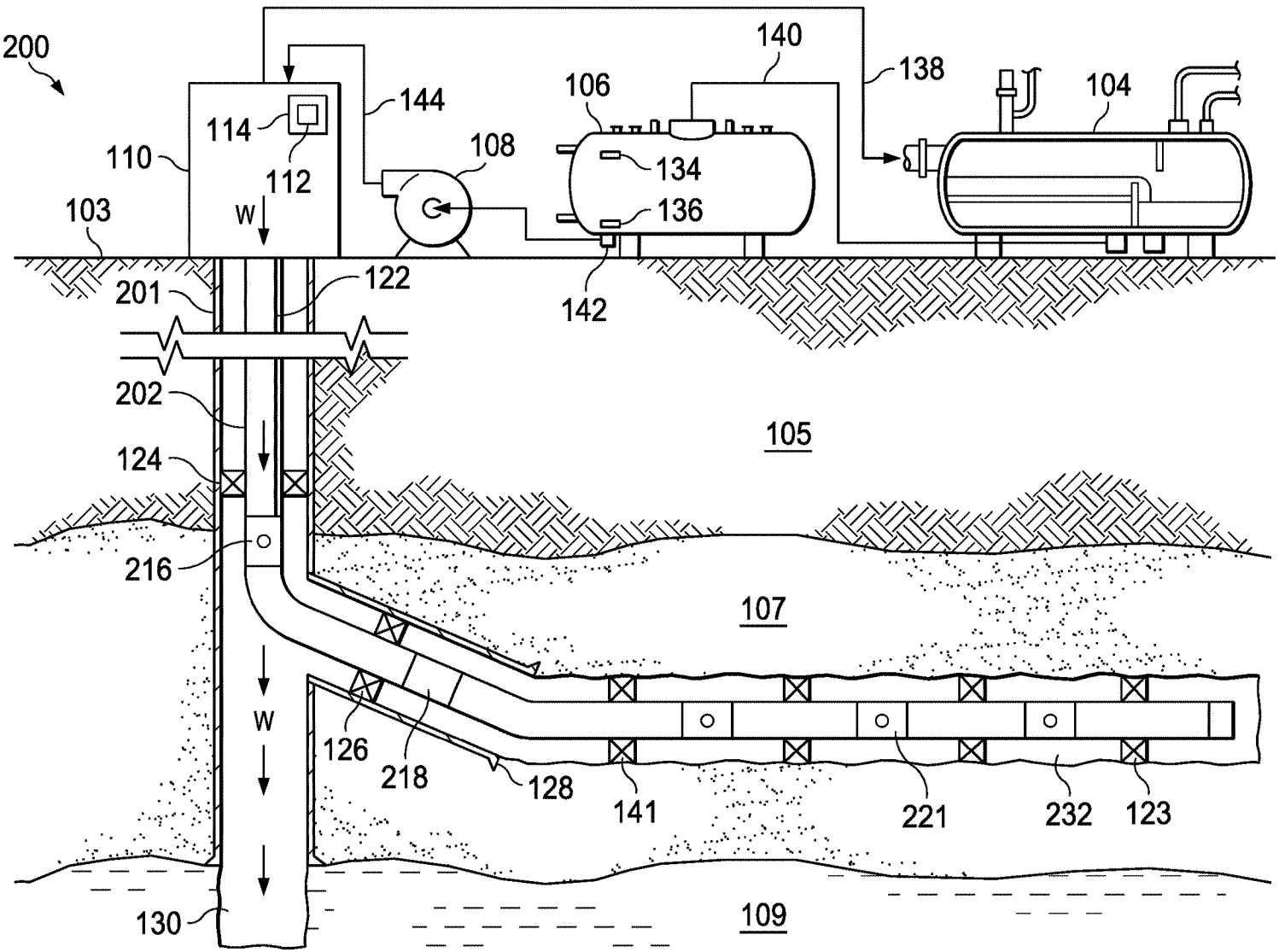
FIG. 4 is a front schematic view of the wellbore assembly of FIG. 3, in water injection mode.

FIGS. 3 and 4 illustrate a similar process to the one shown in FIGS. 1 and 2, but implemented with a different wellbore assembly 200 in a wellbore 201 that includes a lateral wellbore 232 drilled as sidetrack from a vertical wellbore 201. For example, the lateral wellbore 232 can be drilled as a sidetrack from an existing old wellbore 201. The lateral or non-vertical wellbore 232 can be drilled by deploying level 5 completion tools that can keep an access to the main wellbore 201. The non-vertical wellbore 232 can be completed with multiple injection control devices (ICD) 221, and ICV 216, and a downhole valve 218 (e.g., a surface controlled bidirectional isolation valve to control fluid flow inside the tubing) residing downhole of the ICV 216. The drill string 202 extends through a portion of the vertical wellbore 201 and into the lateral wellbore 232.

The lower completion can be disposed in an open hole section of the lateral wellbore 232. The open hole section can extend from a casing shoe 128. The lower completion can include multiple ICDs 221, with each ICD 221 disposed between respective isolation packers 141. Each pair of adjacent packers 141 form an isolated annulus to isolate production zones of the lower completion.

As shown in FIG. 3, during production mode, the ICV 216 remains closed to prevent water from entering the wellbore string 202 while the bidirectional isolation valve (SFIV) 218 remains open to flow production fluid 'F' from the lower completion to the surface 103. As shown in FIG. 4, during injection mode, the ICV 216 residing uphole of the SFIV 218 flows the water into the vertical wellbore 201 while the SFIV 218 remains closed to prevent water from flowing into the lateral wellbore 232 past the SFIV 218.

Figure 5:
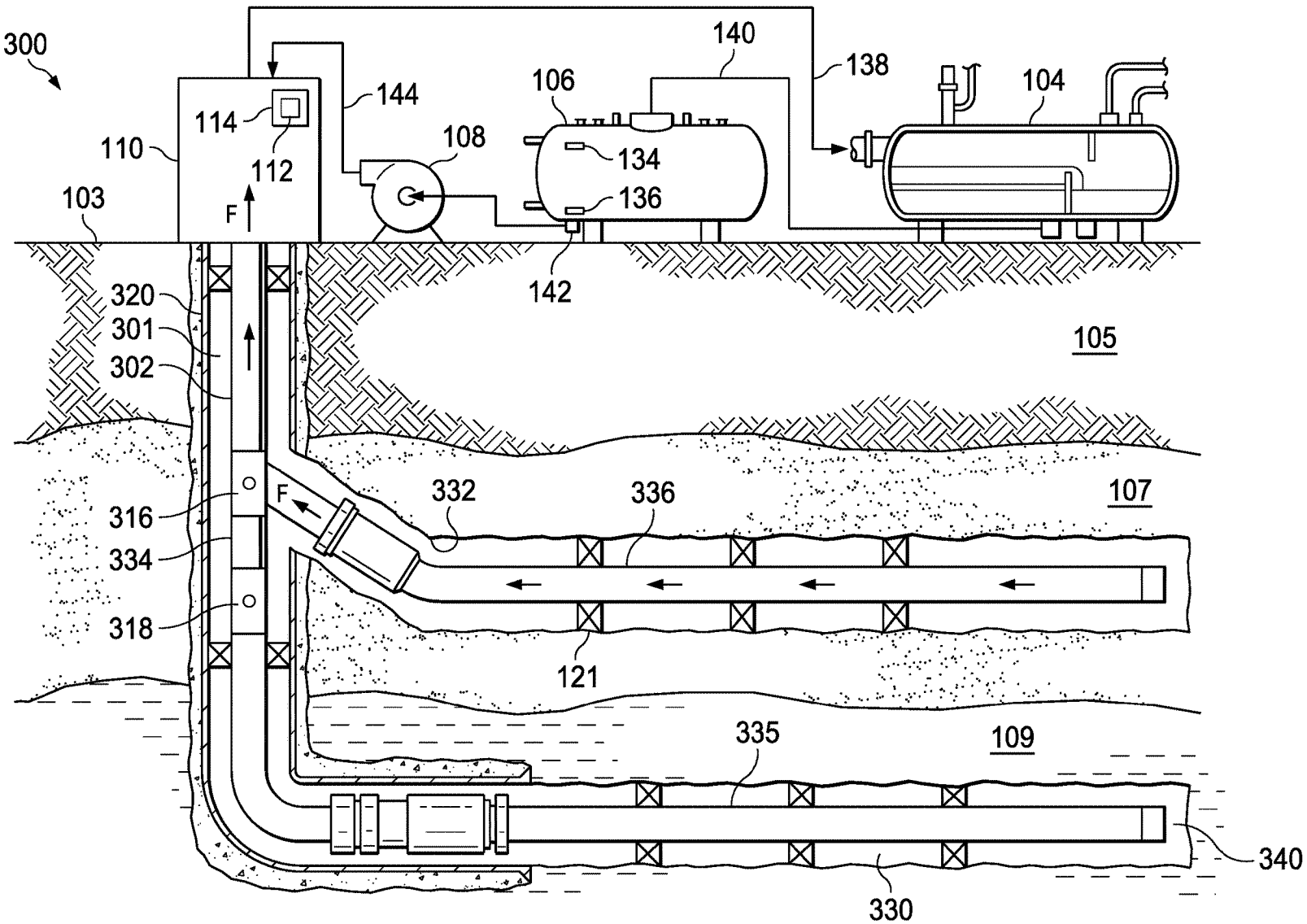
FIG. 5 is a front schematic view of a wellbore assembly according to a third implementation of the present disclosure, the wellbore assembly in production mode.
Figure 6:
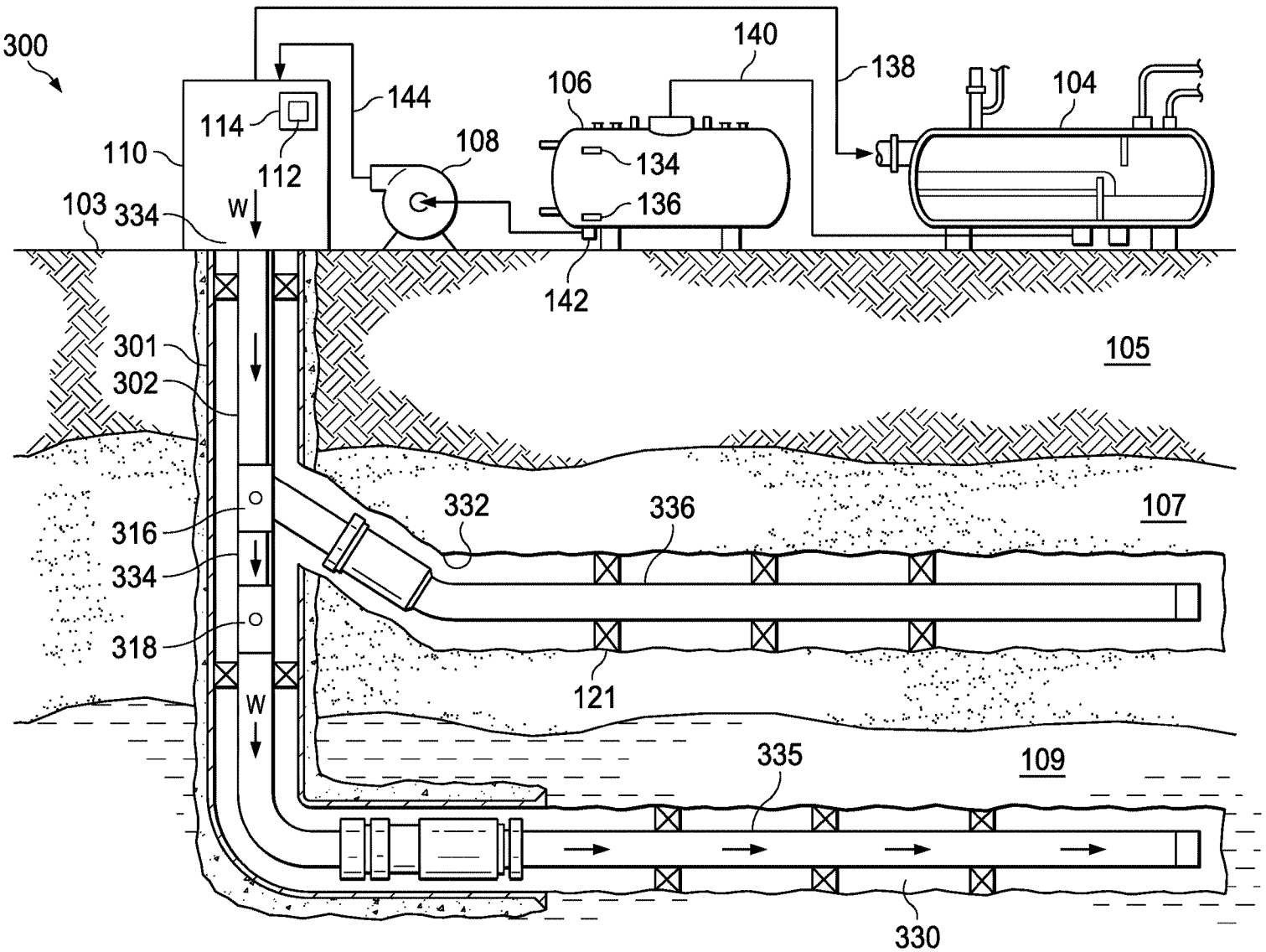
FIG. 6 is a front schematic view of the wellbore assembly of FIG. 5, in water injection mode.

FIGS. 5 and 6 illustrate a similar process to the one shown in FIGS. 1 and 2, but implemented in a multi-lateral wellbore 301. The multi-lateral wellbore 301 can be implemented, for example, for horizontal producers that were placed in thick hydrocarbon reservoirs, in which new laterals are placed above the original hydrocarbon reservoir. In such cases, the "older" leg at the bottom can be converted into an intermittent water injection leg.

The multi-lateral wellbore 301 includes a vertical wellbore 320, a first non-vertical wellbore 332 extending from a first section of the vertical wellbore 320, and a second non-vertical wellbore 330 extending from a second section of the vertical wellbore 320. The wellbore string 302 includes a main string section 334 extending from the surface of the wellbore to a downhole location 340 of the wellbore. The main wellbore string 304 can also include a non-verticals section 335 extending into the second non-vertical wellbore 330. The downhole location 340 can reside at or near a downhole water reservoir 109. The wellbore string 302 also includes a production string 336 fluidically coupled to and extending from the main wellbore string 334 into the first non-vertical wellbore 332. The production string 336 flows production fluid from the first non-vertical wellbore 332 to the main wellbore string 334. The wellbore string 302 also includes downhole valves 316 and 318 (e.g., ICVs, SFIVs, or a combination of the two). The first valve 316 can be disposed at the intersection of the main string 334 and the production string 336. The first valve 316 can also include a three-way valve, a shifting sleeve, or a similar fluid control device. The valves can reside at the main wellbore string 334 or, similar to the embodiment shown in FIG. 3, one of the valves can reside at the production string 336.

As shown in FIG. 5, during production mode, production fluid 'F' flows from the production string 336, through the first valve 316, and up the main wellbore string 302 to the surface 103. During production mode, the second valve 318 remains closed to prevent production fluid from flowing into the lower portion of the main wellbore string 334. As shown in FIG. 6, during injection mode, the first valve 316 prevents production fluid from entering the main wellbore 334 while allowing water 'W' to flow downhole into the non-vertical portion 335 of the main string 334. The second valve 318 remains open to flow the water 'W' to the water reservoir 109 of the wellbore.

In some implementations, the water 'W' injected in the water-bearing injection zone (e.g., the downhole water reservoir) can stimulate the production in the hydrocarbon reservoir. For example, when the water "W' is being injected in the same reservoir that bears the oil zone, the wellbore can feel the pressure of the water which, in turn, can enhance the hydrocarbon displacement through the production process.

Figure 7:
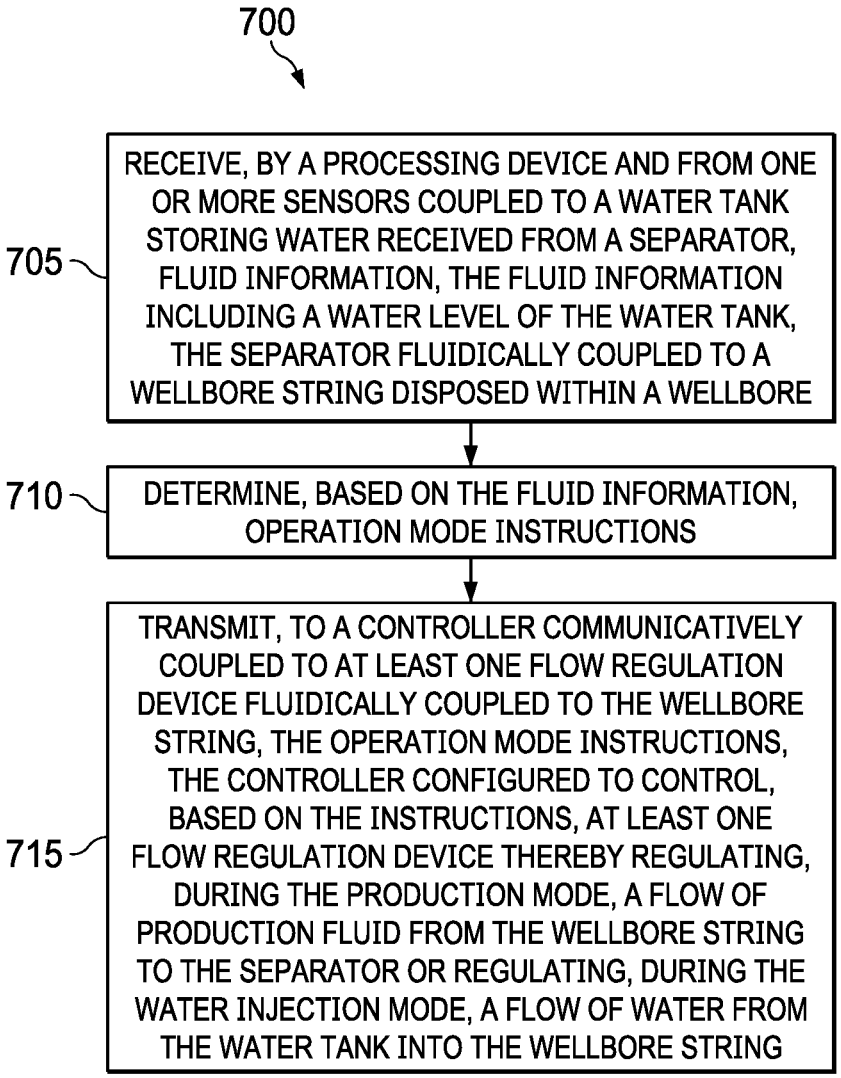
FIG. 7 is a flow chart of an example method of managing unwanted fluids in a production wellbore.

FIG. 7 shows a flow chart of an example method 700 of managing unwanted fluids in a production wellbore. The method includes receiving, by a processing device and from one or more sensors coupled to a water tank storing water received from a separator, fluid information, the fluid information including a water level of the water tank, the separator fluidically coupled to a wellbore string disposed within a wellbore (705). The method 700 also includes determining, based on the fluid information, operation mode instructions (710). The method also includes transmitting, to a controller communicatively coupled to at least one flow regulation device fluidically coupled to the wellbore string, the operation mode instructions. The controller is configured to control, based on the instructions, at least one flow regulation device thereby regulating, during the production mode, a flow of production fluid from the wellbore string to the separator or regulating, during the water injection mode, a flow of water from the water tank into the wellbore string (715).

Figure 8:
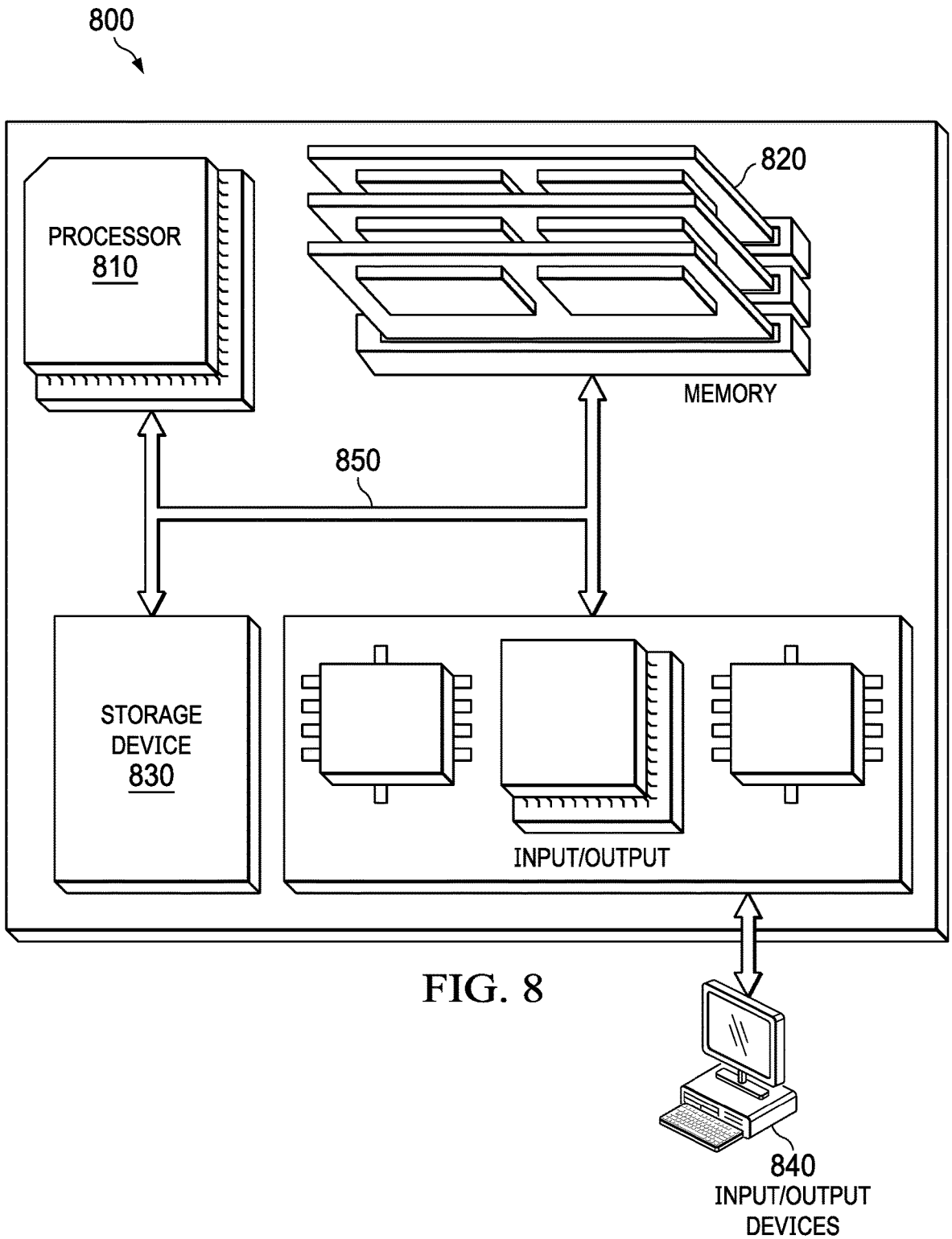
FIG. 8 is a schematic illustration of an example control system or controller for a wellbore assembly according to implementations of the present disclosure.

FIG. 8 is a schematic illustration of an example control system or controller for a flow meter according to the present disclosure. For example, the controller 800 may include or be part of the controller 114 shown in FIGS. 1-6, or may include or be part of the controller 114 and processor 112 shown in FIGS. 1-6. The controller 800 is intended to include various forms of digital computers, such as printed circuit boards (PCB), processors, digital circuitry, or otherwise. Additionally the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 800 includes a processor 810, a memory 820, a storage device 830, and an input/output device 840. Each of the components 810, 820, 830, and 840 are interconnected using a system bus 850. The processor 810 is capable of processing instructions for execution within the controller 800. The processor may be designed using any of a number of architectures. For example, the processor 810 may be a CISC (Complex Instruction Set Computers) processor, a RISC (Reduced Instruction Set Computer) processor, or a MISC (Minimal Instruction Set Computer) processor.

In one implementation, the processor 810 is a single-threaded processor. In another implementation, the processor 810 is a multi-threaded processor. The processor 810 is capable of processing instructions stored in the memory 820 or on the storage device 830 to display graphical information for a user interface on the input/output device 840.

The memory 820 stores information within the controller 800. In one implementation, the memory 820 is a computer-readable medium. In one implementation, the memory 820 is a volatile memory unit. In another implementation, the memory 820 is a non-volatile memory unit.

The storage device 830 is capable of providing mass storage for the controller 800. In one implementation, the storage device 830 is a computer-readable medium. In various different implementations, the storage device 830 may be a floppy disk device, a hard disk device, an optical disk device, or a tape device.

The input/output device 840 provides input/output operations for the controller 1000. In one implementation, the input/output device 840 includes a keyboard and/or pointing device. In another implementation, the input/output device 840 includes a display unit for displaying graphical user interfaces.

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A method comprising:

receiving, by a processing device and from one or more sensors coupled to a water reservoir storing water received from a separator, fluid information, the separator configured to separate, in the separator, production fluid from water and direct the water to the water reservoir, the fluid information including a water level of the water reservoir, the separator fluidically coupled to a wellbore string disposed within a wellbore, the wellbore string defining, with a wall of the wellbore, an annulus;

determining, based on the fluid information, operation mode instructions; and transmitting, to a controller communicatively coupled to at least one valve disposed downhole within the wellbore and fluidically coupled to the wellbore string, the operation mode instructions, the controller configured to control, based on the instructions and during a production mode, the at least one valve to allow a flow of production fluid from the wellbore string to the separator, and the controller configured to control, based on the instructions and during a water injection mode, the at least one valve to pause production and allow a flow of water from the water reservoir into the wellbore string to flow, inside the wellbore string, the water to a downhole water reservoir.

2. The method of claim 1, further comprising, before determining the operation mode instructions:

comparing, by the processing device, the fluid information to a water level threshold;

wherein determining the operation mode instructions comprises determining, based on a result of the comparison, one of 1) instructions to initiate a production mode of the wellbore string, or 2) instructions to initiate a water injection mode of the wellbore string.

3. The method of claim 1, wherein the one or more sensors comprise a first sensor and a second sensor, the fluid information comprising at least one of a high water level detected by the first sensor or a low water level detected by the second sensor, wherein determining the operation mode instructions comprises determining one of 1) instructions to initiate the water injection mode based on the fluid information comprising a high water level, or 2) instructions to initiate the production mode based on the fluid information comprising a low water level.

4. The method of claim 1, wherein the at least one valve comprises a first valve attached to the wellbore string and residing at a production zone, and a second valve attached to the wellbore string and residing at a water injection zone, the controller coupled to the first valve and the second valve, the controller configured to 1) upon receiving instructions to initiate the water injection mode, close the first valve and open the second valve, allowing the water to be injected into the water injection zone through the wellbore string, and configured to 2) upon receiving instructions to initiate the production mode, close the second valve and open the first valve, allowing the production fluid to flow through the wellbore string to the separator.

5. The method of claim 4, wherein the controller is operationally coupled to a fluid pump fluidically coupled to the water reservoir and disposed upstream of the wellbore string, the controller configured to activate, during the water injection mode, the fluid pump, flowing the water from the water reservoir to the wellbore string, and into the water injection zone.

6. A wellbore assembly comprising:

a wellbore string configured to be disposed within a wellbore, the wellbore string configured to extend from a surface of the wellbore to a downhole location of the wellbore, the wellbore string defining, with a wall of the wellbore, an annulus, the wellbore comprising a downhole production zone and a downhole water injection zone;

at least one valve disposed downhole within the wellbore and fluidically coupled to the wellbore string;

a separator disposed at the surface of the wellbore, the separator fluidically coupled to the wellbore string and configured to receive, during a production mode of the wellbore assembly, production fluid from the wellbore string flown from the production zone, the separator configured to separate water from the production fluid; and a water reservoir disposed at the surface of the wellbore and fluidically coupled to the separator and to the wellbore string, the water reservoir configured to receive and store, from the separator, the water separated from the production fluid, the water reservoir configured to direct, into the wellbore string during a water injection mode of the wellbore assembly and while the valve prevents production fluid from flowing uphole through the wellbore string, the water, allowing the wellbore string to direct the water to the water injection zone.

7. The wellbore assembly of claim 6, wherein the water reservoir is configured to flow water to the wellbore string upon reaching a predetermined water level.

8. The wellbore assembly of claim 7, further comprising:

one or more sensors attached to the water reservoir, a controller, and a processing device disposed at or near the surface of the wellbore, the processing device communicatively coupled to the controller and to the one or more sensors, the processing device configured to receive, from the one or more sensors, fluid information comprising a water level in the reservoir, the processing device configured to determine, based on the fluid information, a command to initiate a production mode of the wellbore assembly or a water injection mode of the wellbore assembly, the processing device configured to transmit, to the controller, the command, the controller coupled to the at least one valve and configured to control, based on the command, the valve, regulating a flow of fluid from the wellbore string or into the wellbore string.

9. The wellbore assembly of claim 8, wherein the one or more sensors comprise a first sensor configured to detect a high water level in the reservoir and a second sensor configured to detect a low water level in the reservoir, the processing device configured to determine, based on the fluid information comprising a high water level, a first command to initiate the water injection mode, and the processing device configured to determine, based on the fluid information comprising a low water level, a second command to initiate the production mode.

10. The wellbore assembly of claim 6, wherein the at least one valve comprises:

a first valve attached to the wellbore string and residing at the production zone, and a second valve attached to the wellbore string and residing at the water injection zone, the controller coupled to the first valve and the second valve, the controller configured to 1) upon receiving the first command to initiate the water injection mode, close the first valve and open the second valve, allowing the water to be injected into the water injection zone through the wellbore string, and configured to 2) upon receiving the second command to initiate the production mode, close the second valve and open the first valve, allowing the production fluid to flow up the wellbore string to the separator.

11. The wellbore assembly of claim 6, further comprising a pump fluidically coupled to the water reservoir and disposed upstream of the wellbore string, the pump configured to flow the water from the water reservoir to the wellbore string, and into the water injection zone.

12. The wellbore assembly of claim 6, wherein the separator comprises a portable separator and the water reservoir comprises a portable water tank.

13. The wellbore assembly of claim 6, wherein the wellbore comprises a vertical portion and a non-vertical portion, the non-vertical portion extending from the vertical portion into the production zone, and wherein the production zone is isolated from the water injection zone.

14. The wellbore assembly of claim 6, wherein the wellbore comprises a multi-lateral wellbore comprising a vertical wellbore, a first non-vertical wellbore extending from a first section of the vertical wellbore, and a second non-vertical wellbore extending from a second section of the vertical wellbore, the wellbore string comprising:

a main wellbore string extending from the surface of the wellbore to a downhole location of the wellbore, a production string fluidically coupled to and extending from the main wellbore string into the first non-vertical wellbore, the production string configured to flow production fluid from the first non-vertical wellbore to the wellbore string, and a water injection string fluidically coupled to and extending from the wellbore string into the second non-vertical wellbore, the water injection string configured to receive and flow water from the wellbore string to the second non-vertical wellbore.

15. The wellbore assembly of claim 14, wherein the separator is fluidically coupled to the main wellbore string and configured to receive, during the production mode and from the main wellbore string, the production fluid flown from the production string to the main wellbore string, the water reservoir fluidically coupled to and configured to flow, during the water injection mode, water to the main wellbore string, allowing the wellbore string to flow the water to the water injection string.

16. A system comprising:

at least one processing device; and a memory communicatively coupled to the at least one processing device, the memory storing instructions which, when executed, cause the at least one processing device to perform operations comprising:

receive, from one or more sensors coupled to a water reservoir storing water received from a separator, fluid information, the separator configured to separate, in the separator, production fluid from water and direct the water to the water reservoir, the fluid information including a water level of the water reservoir, the separator fluidically coupled to a wellbore string disposed within a wellbore the wellbore string defining, with a wall of the wellbore, an annulus;

determine, based on the fluid information, operation mode instructions; and transmit, to a controller communicatively coupled to at least one valve disposed downhole within the wellbore and fluidically coupled to the wellbore string, the operation mode instructions, the controller configured to control, based on the instructions and during a production mode, the at least one valve thereby regulating a flow of production fluid from the wellbore string to the separator and the controller configured to control, based on the instructions and during a water injection mode, the at least one valve to regulate a flow of water from the water reservoir into the wellbore string to flow, through the wellbore string, the water to a downhole water reservoir while production is paused.

17. The system of claim 16, wherein the operations further include, before determining the operation mode instructions:

compare, by the processing device, the fluid information to a water level threshold;

wherein determining the operation mode instructions comprises determining, based on a result of the comparison, one of 1) instructions to initiate a production mode of the wellbore string, or 2) instructions to initiate a water injection mode of the wellbore string.

18. The system of claim 16, wherein the one or more sensors comprise a first sensor and a second sensor, the fluid information comprising at least one of a high water level detected by the first sensor or a low water level detected by the second sensor, wherein determining the operation mode instructions comprises determining one of 1) instructions to initiate the water injection mode based on the fluid information comprising a high water level, or 2) instructions to initiate the production mode based on the fluid information comprising a low water level.

19. The system of claim 16, wherein the at least one valve comprises a first valve attached to the wellbore string and residing at a production zone, and a second valve attached to the wellbore string and residing at a water injection zone, the controller coupled to the first valve and the second valve, the controller configured to 1) upon receiving instructions to initiate the water injection mode, close the first valve and open the second valve, allowing the water to be injected into the water injection zone through the wellbore string, and configured to 2) upon receiving instructions to initiate the production mode, close the second valve and open the first valve, allowing the production fluid to flow through the wellbore string to the separator.

20. The system of claim 16, wherein the controller is operationally coupled to a fluid pump fluidically coupled to the water reservoir and disposed upstream of the wellbore string, the controller configured to activate, during the water injection mode, the fluid pump, flowing the water from the water reservoir to the wellbore string, and into the water injection zone.

* * * * *